US005095966A

United States Patent [19]

Rogers

[11] Patent Number: 5,095,966

[45] Date of Patent: Mar. 17, 1992

[54] VERTICAL BLIND SUSPENSION UNITS

[75] Inventor: Paul E. Rogers, Welgemoed, South Africa

[73] Assignee: Exactocraft (Proprietary) Limited, Paarden Eiland, South Africa

[21] Appl. No.: 668,182

[22] Filed: Mar. 12, 1991

[30] Foreign Application Priority Data

Aug. 29, 1990 [ZA] South Africa ..... 90/6874

[51] Int. Cl.[5] ..... E06B 9/00

[52] U.S. Cl. ..... 160/168.1; 160/900

[58] Field of Search ..... 160/168.1, 176.1, 166.1, 160/172, 173, 177, 178.1, 900

[56] References Cited

U.S. PATENT DOCUMENTS

| | | | |
|---|---|---|---|
| 3,468,360 | 9/1969 | Payne | 160/176.1 X |
| 4,122,884 | 10/1978 | Salzmann | 160/178.1 X |
| 4,214,622 | 7/1980 | Debs | 160/168.1 |
| 4,262,728 | 4/1981 | Debs | 160/168.1 |
| 4,616,688 | 10/1986 | Agos | 160/176.1 |
| 4,732,202 | 3/1988 | Anderson | 160/168.1 |
| 4,799,527 | 1/1989 | Villoch et al. | 160/168.1 |
| 4,848,434 | 7/1989 | Morris et al. | 160/178.1 X |
| 4,848,435 | 7/1989 | Helver | 160/176.1 |
| 4,936,370 | 6/1990 | Uecker et al. | 160/168.1 |

FOREIGN PATENT DOCUMENTS 1589830 5/1981 United Kingdom .

*Primary Examiner*—David M. Purol
*Attorney, Agent, or Firm*—Larson and Taylor

[57] ABSTRACT

A vertical blind assembly, including a minimum number of parts, has a carrier member supporting a circular gear rack driven by a drive rod. The gear rack can be assembled in any position in the carrier member and on rotation of the rod will be rotated to its end position. On further rotation of the rod the ends of the rack merely deflects to provide a clutch effect. Thereby misaligned slats can be easily aligned.

6 Claims, 3 Drawing Sheets

VERTICAL BLIND SUSPENSION UNITS

FIELD OF INVENTION

The present invention relates to vertical blind suspension units.

BACKGROUND TO INVENTION

Conventionally in vertical blind systems each louvre blind includes a blind slat which is attached centrally at its top end to a carrier member which is rotatably and slidably supported in a support track rail. Thereby each blind slat can be rotated about a vertical axis and be shifted sideways along the support rail.

Various suspension units for vertical louvre blinds are known. Normally these suspension units include a carrier member, which suspends a vertical louvre blind vane or slat from a support rail attached to a ceiling or a wall. The known arrangements normally operate on a worm and pinion type of mechanism and include a number of individual parts, the quantity of which have a direct effect on manufacturing and assembly costs. Also the control rod is centrally offset.

It is an object of the invention to suggest another suspension arrangement by means of which the number of parts can be reduced and improved so as to reduce the manufacturing and assembly costs.

SUMMARY OF INVENTION

According to the invention, a assembly for vertical louvre blinds, which unit includes a carrier member, which is movably mountable in a support track rail which rotatably supports a drive rod, to be rotatable about its rotational axis, and connection means for rotatably connecting a vertical blind slat to the carrier member, a first passage provided extending through the carrier member for receiving a rotatable drive rod of a vertical louvre blind system; a pivotable member located in the first passage for driving cooperation with the drive rod when in position therein for pivotation about an axis at an angle to the rotational axis of the drive rod; a second passage in the carrier member extending from the first passage; a link member connected to tee pivotable member and extending through the second passage to the outside of the carrier member; and a slat connection on the link member for connection to a vertical louvre blind slat.

The link member may have a rotational axis which, in use, is inclined at an angle of less than 90° to the rotational axis of the drive rod when in position in the first passage.

The pivotable member may be a curved rack gear member for driving cooperation with the drive rod being gear shaped in end view.

According to the invention there is provided a vertical blind assembly comprising a number of vertically oriented slats disposed in spaced part relation to one another, each slat having a longitudinal axis and being supported by means of a carrier member movably arranged in a support track rail, each slat further being independently rotatable about its own longitudinal axis, and the slats being collectively positionable between an extended and a closed orientation relative to and along the length of the support track rail, the improvement comprising:

a) a profiled drive rod having a longitudinal axis and being mounted in the support track rail to be rotatable about its longitudinal axis;

b) each carrier member having a base plate inclined relative to the longitudinal axis of the drive rod;

c) a first passage extending through each carrier member above its base plate, said drive rod passing through said first passage;

d) a circular gear rack having a disc with radially located gear teeth provided thereon, the disc slidably resting on the base plate, the gear rack being located in the first passage of each carrier member with its gear teeth in mesh with the drive rod for pivotation of the gear rack about an axis at an angle to the longitudinal axis of the drive rod, the disc being tapered at both of its ends;

e) a second passage in the form of a hole in the base plate of each carrier member extending, in use, downwardly from the first passage to the outside of the carrier member, the second passage further having a wide open end extending from one side edge of the base plate and leading through a neck to terminate in the hole, the hole having a diameter slightly wider than the neck;

f) a link member connected to the disc of each gear rack and extending through the hole of the second passage in the base plate to the outside of its associated carrier member, the link member at the neck having a diameter slightly larger than the neck of the second passage, and the link member having a rotational axis which is inclined at an angle of less than 90° to the longitudinal axis of the drive rod;

g) a first stop element provided on the underside of the base plate;

h) a second stop element provided on the link member for abutting against the first stop element to limit the rotation of the link member not to exceed about 180°; and i) a slat connection on each link member connecting it to its slat to cause the slat to rotate about its longitudinal axis, each slat connection supporting its slat such that in use, the slat remains vertical when it is rotated about its longitudinal axis.

The first passage in each carrier member may be equidistant from the sides of the carrier member.

Each slat connection may include a disc type formation at the end of the link member for cooperating with a complementary cut-out at the upper end of its slat.

Each carrier member may be slidably support in the support track rail, or each carrier member may be provided with wheels for rollably supporting it in the support rail.

BRIEF DESCRIPTION OF DRAWINGS

The invention will now be described by way of example with reference to the accompanying schematic drawings.

In the drawings there is shown in

DETAILED DESCRIPTION OF DRAWINGS

Figure 1:
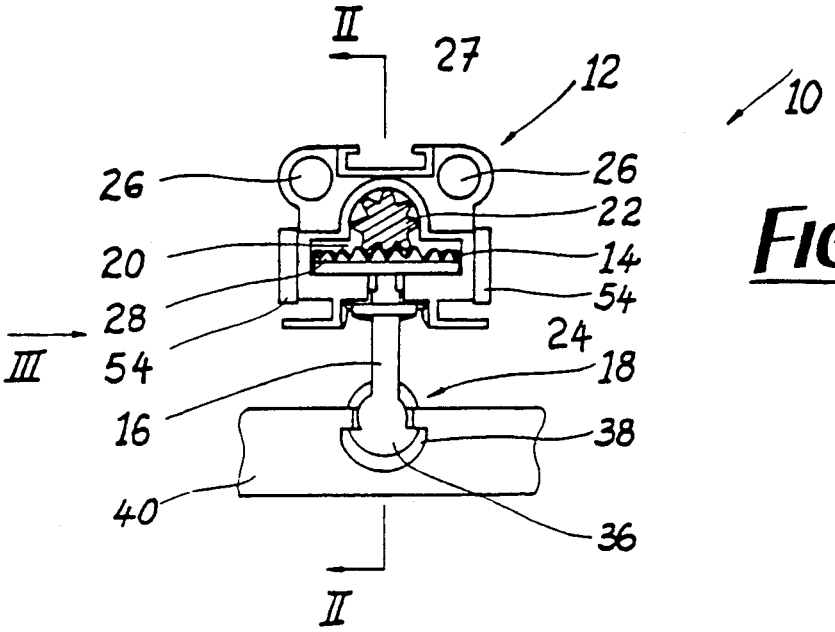
FIG. 1 is an end view of a suspension unit for a vertial louvre blind system in accordance with the invention, showing part of the upper end of a louvre blind slat but without the support track rail.
Figure 2:
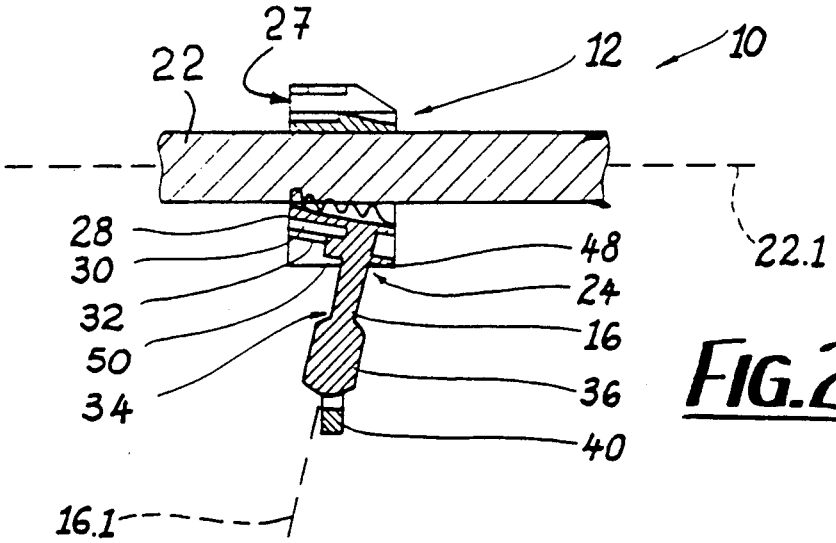
FIG. 2 is a sectional side view seen along arrows II—II in FIG. 1.
Figure 3:
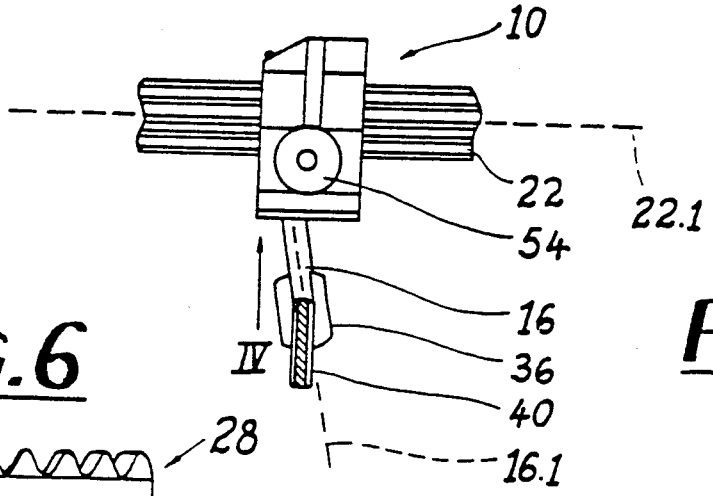
FIG. 3 is a side view seen along arrow III in FIG. 1.

Referring to FIGS. 1 to 3 of the drawings, the suspension unit for vertical louvre blinds, generally indicated by reference numeral 10, includes a carrier member 12, a pivotable member 14, a link shaft 16 and a universal slat connection 18.

The carrier member 12 has a first passage 20 for receiving the profiled tilt rod or shaft 22 of a vertical louvre blind system, as well as the pivotable member 14. It has a second passage 24, which extends at an angle from the first passage 20 and to below. Further details of the passage 24 will be given with reference to FIG. 4.

Figure 7:
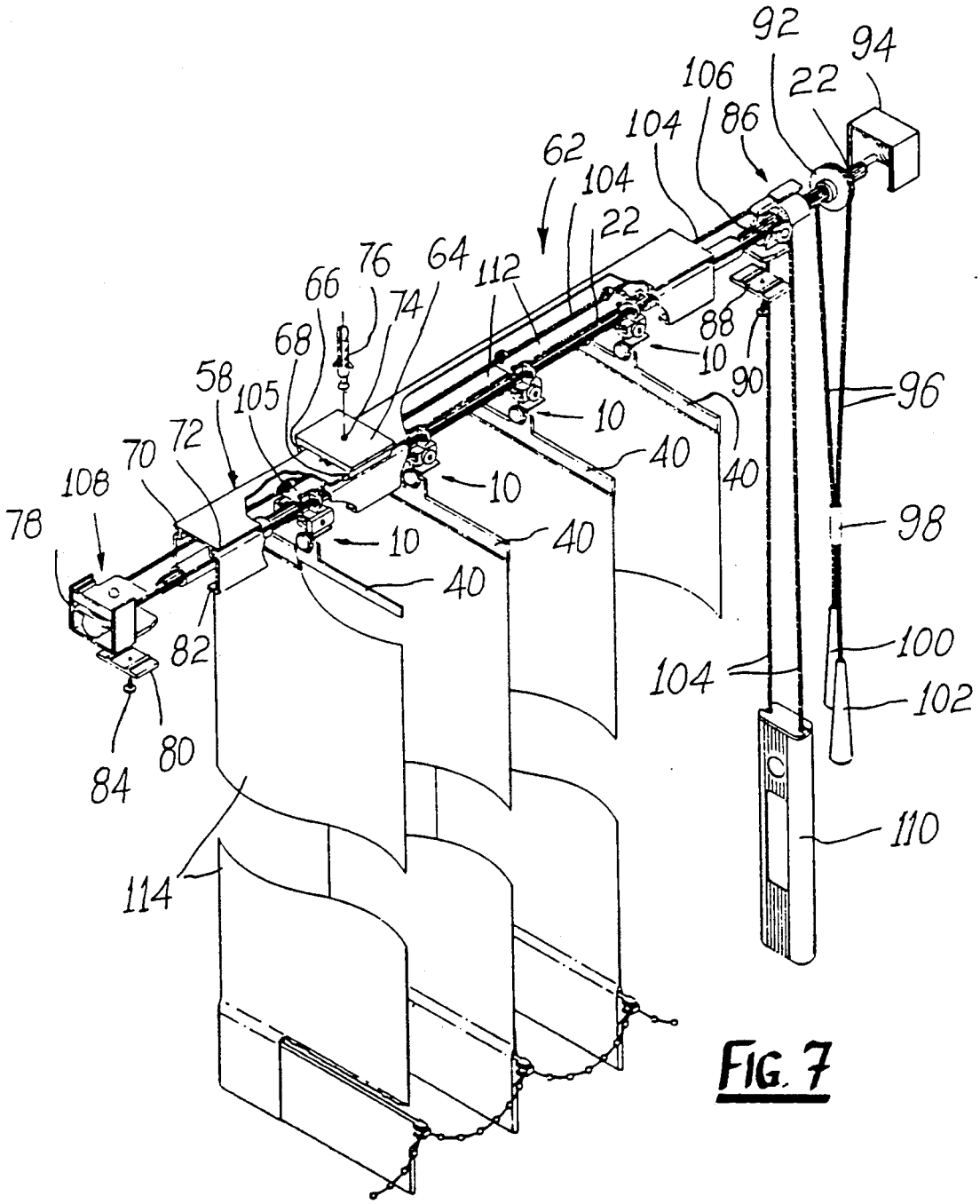
FIG. 7 is a pictorial view of a vertical louvre blind system incorporating components as illustrated in FIGS. 1 to 6.

The carrier member 12 also has side passages 26 for receiving conventional operating cords, cables, strings or chains and a central channel 27 for receiving spacer links (see FIG. 7).

The pivotable member 14 has a curved gear rack 28 joined to an upper end of a disc 30. The disc 30 is located at an inclined plane on a base plate 32 provided at the bottom of the carrier member 12. The shaft 16 has a rotational axis 16.1. The shaft 16 extends downwardly from the disc 30 and, at its bottom free end 34, carries the universal connection 18, which has a disc shaped part 36. This cooperates with an equivalently shaped cut-out 38 at the upper edge of a vertical louvre blind slat 40 (see FIG. 1).

Figure 4:
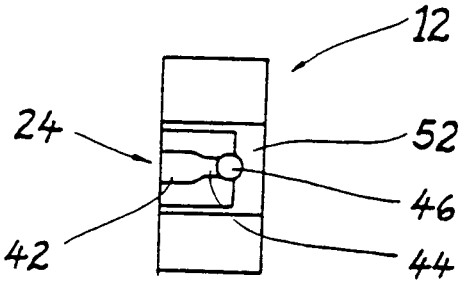
FIG. 4 is a view from below onto the carrier unit only seen along arrow IV in FIG. 3.

The passage 24 is provided in the base plate 32 and is in the form of a slot as shown in FIG. 4 having an open end 42, a neck portion 44 and a round hole 46 (of slightly larger diameter than the width of the neck 44). The shaft 16 is rotatably located in the hole 46 and has a disc 48 on which an upwardly directed limitation stop 50 is provided. This stop 50 abuts against the cross bar 52 (see FIG. 4) to limit the rotation of the shaft 16 and the rack 28 to 180°.

Figure 5:
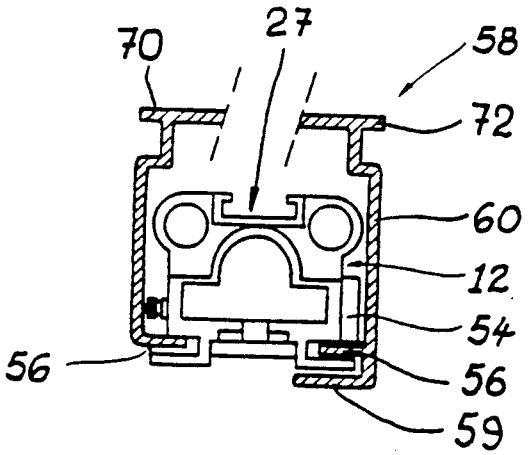
FIG. 5 is an end view of the carrier unit only as fitted into a support track rail.

On the sides of the carrier member 12 support wheels 54 are provided. However, as shown in FIG. 5 on the lefthand side the carrier member 12 may also slide or skid on the bottom arm 56 of the support rail 58 in stead of rolling by means of the rollers 54 (as shown on the righthand side of FIG. 5). If required, as shown in FIG. 7, the cover flange 59 may be omitted.

On assembly various suspension arrangements 10 are fitted onto the tilt rod 22 as shown in FIGS. 1 to 4 and are pushed into the support rail 58 (FIG. 5 and FIG. 7). Then a slat 40 is fitted to each of the discs 36 of the universal connection 18 as shown in FIG. 1.

As is shown in FIGS. 2 and 3 the rotational axis 16.1 of the shaft 16 is inclined at an angle of less than 90° to the longitudinal rotational axis 22.1 of the drive rod 22.

Figure 6:
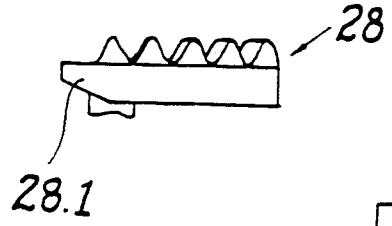
FIG. 6 is on a larger scale, a detail of one extreme end of the gear rack illustrated in FIGS. 1 and 2.

FIG. 6 shows that the gear rack 28 is tapered at its ends 28.1. When the rod 22 is rotated in one direction and reaches one of the ends 28.1 of the gear rack 28, it will cause such end 28.1 to flex and thus the gear rack 28 acts as a clutch and does not rotate further. When all gear racks 28 are in this position all shafts 16 are aligned and the slats 40 are parallel. Thereafter, by rotating the rod 22 all of the shafts 16 are turned to be constantly parallel and in the same angular position. Thus the various slats 40 are moved through the same angular displacement and are positioned parallel to each other.

For pulling the slats 40 together, the control cords, cables, strings or chains, passing through the openings 26 in the carrier member 12, are operated in conventional manner.

As is shown in FIGS. 2 and 5 the rod 22 is located centrally in the carrier member 12. This facilitates balancing and provides more effective operation.

Also the centrally located rod 22 may be made flexible so that support rail 58 may curved if required.

As set out above, in accordance with the invention, the suspension arrangement 10 utilizes a continuously formed gear profiled tilt rod or tilt shaft 22. A special feature is the engagement of the curved gear rack 28 with the aforesaid gear profiled tilt rod 22. In this manner by means of only one part the rotational movement of the horizontal tilt rod 22 is converted into a vertical rotation of the link shaft 16 to obtain the correct function of the vertical louvre blind slats 40.

The limitation stop 50 on rotation through a predetermined angle abuts against the cross bar 52 thereby preventing further rotation. The curved gear rack 28 and the disc 30 are so designed to act as a clutch in the extreme positions, so as to allow initial alignment of the gear racks 28 and therewith of the shafts 16 and the parts 36. However, such design also can assist in preventing damage to the system.

As can be seen in FIG. 5, an advantageous feature of the arrangement 10 is that it can operate with or without the support wheels 54. Thus on the lefthand side sliding or skidding on the rail track arm 56 takes place, whereas, on the righthand side, a wheel 54 is utilized. Obviously both sides will slide or will be provided with wheels 54.

In FIG. 7 a pictorial view of a vertical louvre blind system incorporating components as illustrated in FIGS. 1 to 6 is shown.

The overall system, generally indicated by reference numeral 62, includes the following components:

1. A support track rail 58.
2. A number of suspension units 10 with carrier members 12 slidingly fitted in the support track rail 58.
3. A number of suspension brackets 64 (only one shown for purposes of clarity) having engaging lips 66, 68 engaging underneath the flanges 70, 72 of the rail 58 and having a hole 74 through which a screw can be passed for screwing into an expansion plug 76 provided in a hole in a supporting structure, such as a sill or ceiling.
4. An end cap 78 fitting into the end of the rail 58 and being lockable thereto by means of a clamp plate 80 fitting below the flanges 56 of the rail 58 and being screw attached by means of a self tapping screw 84 to the end cap 78.
5. A further end cap 86 fitting into the opposite end of the rail 58 and also being attachable thereto by means of a clamping plate 88 and a selftapping screw 90.
6. An operating pulley 92 fitted over the shaft 22 where it extends through the end cap 86.
7. An end cover 94 fitted to the end cap 86 to enclose the pulley 92.
8. A cord 96 passing over the pulley 92 and passing through a sleeve 98, the ends of the rope being attached to gripping handles 100, 102.
9. A cord 104, knotted at 105, to form an endless cord passing over pulleys 106 and through the holes 26 in the carrier member 10, and being redirected by an idler wheel (not shown) provided in the end cap 78, the the cord 104 passing through a weight handle 110.

10. Conventional spacer links 112 engaging by means of tongues into the channel formation 27 provided in each carrier member 10.

11. Vertical slats 114 attached to the slat members 40.

When assembled and suspended as shown in FIG. 7, the angular position of the slats 114 is adjusted by means of the cord 96 by pulling either the handle 100 or the handle 102. By pulling one of these handles downwardly the slats 114 are all rotated about a vertical axis either clockwise or anti-clockwise as required.

Initially one handle is pulled until all slats are parallel. Thereafter, when pulling one of the handles 100 or 102 the slats will be rotated in unison and parallel. It must be noted that the slats are rotated through 180° if the rod 22 is rotated through 180°. Therefore a number of revolutions of the rod 22 for effecting rotation through 180° is not necessary as is the case in conventional systems.

If the slats 114 have to be moved together, then the cord 104 is pulled through the handle 110 and thereby the carrier members 10 are moved together or apart as the case may be. This is similar to the conventional arrangement of vertical blind systems.

All of the components, except the screws 84, 90 and the rail 58, may be made of plastics material, e.g. acetal resin engineering plastics or any other suitable plastics material.

I claim:

1. A vertical blind assembly comprising a number of vertically oriented slats disposed in spaced apart relation to one another, each slat having a longitudinal axis and being supported by means of a carrier member movably arranged in a support track rail, each slat further being independently rotatable about its own longitudinally axis, and the slats being collectively positionable between an extended and a closed orientation relative to and along the length of the support track rail, the improvement comprising:

a) a profiled drive rod having a longitudinal axis and being mounted in the support track rail to be rotatable about its longitudinal axis;

b) each carrier member having a base plate inclined relative to the longitudinal axis of the drive rod;

c) a first passage extending through each carrier member above its base plate, said drive rod passing through said first passage;

d) a circular gear rack having a disc with radially located gear teeth provided thereon, the disc slidably resting on the base plate, the gear rack being located in the first passage of each carrier member with its gear teeth in mesh with the drive rod for pivotation of the gear rack about an axis at an angle to the longitudinal axis of the drive rod, the disc being tapered at both of its ends;

e) a second passage in the form of a hole in the base plate of each carrier member extending, in use, downwardly from the first passage to the outside of the carrier member, the second passage further having a wide open end extending from one side edge of the base plate and leading through a neck to terminate in the hole, the hole having a diameter slightly wider than the neck;

f) a link member connected to the disc of each gear rack and extending through the hole of the second passage in the base plate to the outside of its associated carrier member, the link member at the neck having a diameter slightly larger than the neck of the second passage, and the link member having a rotational axis which is inclined at an angle of less than 90° to the longitudinal axis of the drive rod;

g) a first stop element provided on the underside of the base plate;

h) a second stop element provided on the link member for abutting against the first stop element to limit the rotation of the link member not to exceed about 180°; and i) a slat connection on each link member connecting it to its slat to cause the slat to rotate about its longitudinal axis, each slat connection supporting its slat such that in use, the slat remains vertical when it is rotated about its longitudinal axis.

2. An assembly as claimed in claim 1, in which the first passage in each carrier member is equidistant from the sides of the carrier member.

3. An assembly as claimed in claim 1, in which each slat connection includes a disc type formation at the end of the link member for cooperating with a complementary cut-out the upper end of its slat.

4. An assembly as claimed in claim 1, in which each carrier member is slidably supported in the support track rail.

5. An assembly as claimed in claim 1, in which each carrier member is provided with wheels for rollably supporting it in the support rail.

6. An assembly as claimed in claim 1 where the taper of the ends of said disc is such that the gear rack flexes when said drive rod reaches an end of the gear rack whereby the gear rack does not rotate further.

* * * * *